US005353099A

United States Patent [19]

Tsunoda

[11] Patent Number: 5,353,099

[45] Date of Patent: Oct. 4, 1994

[54] DRIVE DEVICE IN AN IMAGE-FORMING MACHINE

[75] Inventor: Arihiro Tsunoda, Osaka, Japan

[73] Assignee: Mita Industrial Co., Ltd., Osaka, Japan

[21] Appl. No.: 34,128

[22] Filed: Mar. 18, 1993

[30] Foreign Application Priority Data

Apr. 20, 1992 [JP] Japan ..... 4-099761

[51] Int. Cl.[5] ..... G03G 15/00

[52] U.S. Cl. ..... 355/200; 74/DIG. 10

[58] Field of Search ..... 355/200, 211, 210; 74/DIG. 1

[56] References Cited

U.S. PATENT DOCUMENTS

| | | | |
|---|---|---|---|
| 1,814,825 | 7/1931 | Cameron | 74/DIG. 10 |
| 4,942,776 | 7/1990 | Quirk et al. | 74/DIG. 10 |
| 5,012,691 | 5/1991 | Bertot | 74/DIG. 10 |
| 5,023,660 | 6/1991 | Ebata et al. | 355/210 X |
| 5,030,174 | 7/1991 | Eguchi | 355/210 |
| 5,126,800 | 6/1992 | Shishido et al. | 355/211 |
| 5,210,574 | 5/1993 | Kita | 355/211 |

FOREIGN PATENT DOCUMENTS

| | | |
|---|---|---|
| 60-100160 | 6/1985 | Japan . |
| 1-307774 | 12/1989 | Japan . |

*Primary Examiner*—A. T. Grimley
*Assistant Examiner*—Nestor R. Ramirez
*Attorney, Agent, or Firm*—Beveridge, DeGrandi, Weilacher & Young

[57] ABSTRACT

A transmission member is fitted to a flange member to which a photosensitive drum is fitted. The transmission member is made of a synthetic resin and includes an output gear that engages with a drive gear of a transfer drum. The output gear is formed on the outer periphery of a cylindrical portion formed on one end side of the transfer member. An outer peripheral support surface is formed along the circumference on one end side of the flange member. The inner peripheral surface of a cylindrical portion of the output gear is fitted onto, and is supported by, the outer peripheral support surface of the flange member.

4 Claims, 4 Drawing Sheets

DRIVE DEVICE IN AN IMAGE-FORMING MACHINE

FIELD OF THE INVENTION

The present invention relates to a drive device that is applicable to rotatingly drive a photosensitive drum and a transfer drum in an image-forming machine such as a multi-color copying machine or a multi-color laser beam printer.

Description of the Prior Art

In an image-forming machine such as a multi-color copying machine or a multi-color laser beam printer, a photosensitive drum and a transfer drum are rotatably arranged. A photosensitive material is disposed on the peripheral surface of the photosensitive drum, and a toner image is formed on the photosensitive material while the photosensitive drum is rotated in a predetermined direction. The transfer drum includes a pair of flange members provided at its both side edges and a transfer sheet member. The transfer sheet member which is made of a soft synthetic resin sheet covers the peripheral surfaces of the pair of flange members at both side edges. The transfer drum is rotatably mounted and is allowed to move between an acting position and a non-acting position. An image-forming sheet member is removably fitted onto the transfer sheet member of the transfer drum. The toner image formed on the photosensitive material is transferred onto the image-forming sheet member fitted onto the transfer drum. At the transfer operation, the transfer drum is located at the acting position so that the surface of the image-forming sheet member comes in intimate contact with the peripheral surface of the photosensitive drum. The photosensitive drum and the transfer drum are rotated in synchronism with each other. An output gear is disposed at one side edge of the photosensitive drum, and a drive gear that engages with the above output gear is disposed at one side edge of the transfer drum. The rotation of the photosensitive drum that is rotatingly driven is transmitted to the transfer drum via the output gear and the drive gear. When a multi-color image is to be formed on the image-forming sheet member, formation and transfer of the toner image are executed for each of a plurality of colors. During the step of forming image, the transfer drum continues to move repetitively between the acting position and the non-acting position.

In the image-forming machine of the type mentioned above, the circumferential length of the transfer drum must be a maximum length that can be copied plus $\alpha$ and hence, it is considerably long. Therefore, the transfer drum has a diameter much greater than that of the photosensitive drum (e.g., the transfer drum is 156 mm in diameter, while the photosensitive drum is 78 mm in diameter), and, accordingly, the drive gear of the transfer drum has a diameter of pitch circle which is considerably greater than that of the output gear of the photosensitive drum (for instance, twice in size). Such a fundamental constitution has been disclosed in Kita's U.S. Pat. No. 5,210,574 assigned to the same assignee as that of this U.S. patent application.

The drive gear of the transfer drum has a considerably large diameter as described above. When the drive gear is formed by molding a synthetic resin, therefore, it is difficult to maintain a predetermined precision due to contraction or the like as the resin cools. Therefore, formation of the drive gear by molding a synthetic resin is not suitable. So far, therefore, the drive gear of the transfer drum has been made of a sintered metal that is obtained by sintering a metal such as a metal powder as a starting material, and the output gear of the photosensitive drum that engages with the above gear has also been made of a metal.

The following problems remain unsolved in the conventional device in which the drive gear of the transfer drum and the output gear of the photosensitive drum are both made of a metal.

(1) Large noise is produced as the gears mesh with each other.

(2) If a lubricant such as grease is applied to the portions of the gears where they mesh, the toner is liable to adhere to such portions.

(3) The gears become relatively expensive when they are made of a sintered metal.

As a means for solving the above-mentioned problems, it can be contrived to form the drive gear of the transfer drum having a relatively large diameter by using a metal and to form the output gear of the photosensitive drum having a relatively small diameter by using a synthetic resin. When the gear made of the metal and the gear made of the synthetic resin are brought into mesh with each other, the following merits are achieved: i.e., (1) Small noise is produced as the gears mesh with each other.

(2) There is no need of applying a lubricant to the portions of the gears where they mesh.

(3) The gear of the synthetic resin can be mass-produced at a relatively low cost. As described above, during the step of forming image, the transfer drum continues to move repetitively between the acting position and the non-acting position. According to the repetitive motion of the transfer drum, the drive gear of the transfer drum repeats the engagement and disengagement (which is not a perfect disengagement, as will be mentioned later) with respect to the output gear of the photosensitive drum that engages therewith. The output gear of the photosensitive drum made of the synthetic resin repetitively receives an impact load in the radial direction and, therefore, must have a considerable degree of strength in the radial direction. Such a strength is generally obtained:

(1) by increasing the thickness of the gear portion, or (2) by providing a gear body with a plurality of radial ribs.

However, the above means involve the following problems.

(1) When the gear portion has an increased thickness, the gear portion, in particular tooth portions contract nonuniformly as they cool in molding, making it difficult to maintain a desired precision.

(2) When the gear body is provided with a plurality of radial ribs, the rate of cooling becomes nonuniform, making it difficult to maintain a desired precision.

SUMMARY OF THE INVENTION

The object of the present invention therefore is to provide a drive device in an image-forming machine equipped with an output gear of the photosensitive drum which has a strength enough to withstand the load repetitively applied from the transfer drum in the radial direction and which maintains a predetermined precision.

In order to achieve the above object according to the present invention, there is provided a drive device in an image-forming machine in which a transmission member is detachably fitted to a flange member that is so fitted to a photosensitive drum as to rotate together therewith, said transmission member is made of a synthetic resin and includes an output gear that engages with a drive gear of a transfer drum, said output gear is formed on the outer periphery of a cylindrical portion formed on one end side of the transmission member, an outer peripheral support surface is formed along the circumference on one end side of the flange member, and an inner peripheral surface of the cylindrical portion of the output gear is fitted to, and supported by, the outer peripheral support surface.

DETAILED DESCRIPTION OF THE PREFERRED EMBODIMENTS

Figure 1:
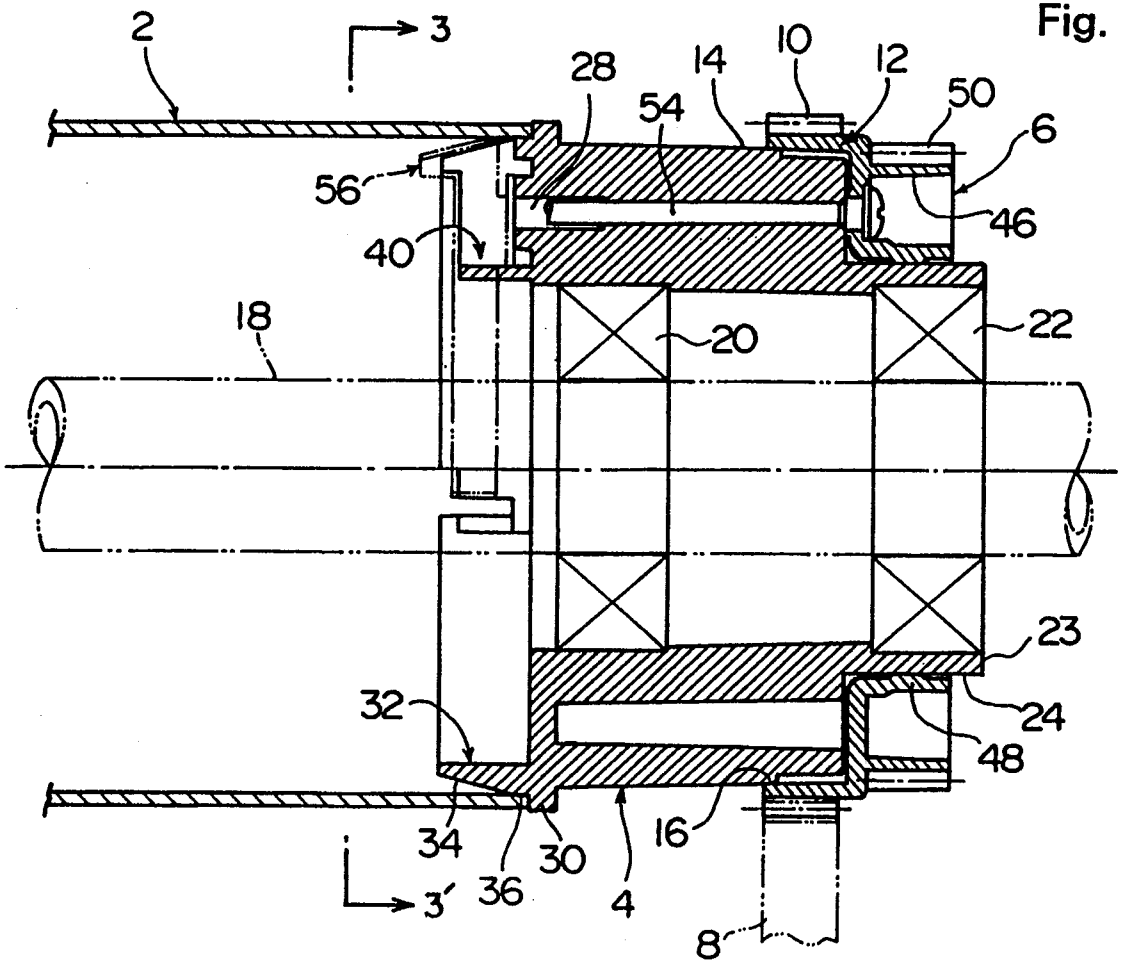
FIG. 1 is a sectional schematic view illustrating main portions of a drive device in an image-forming machine according to an embodiment of the present invention.
Figure 2:
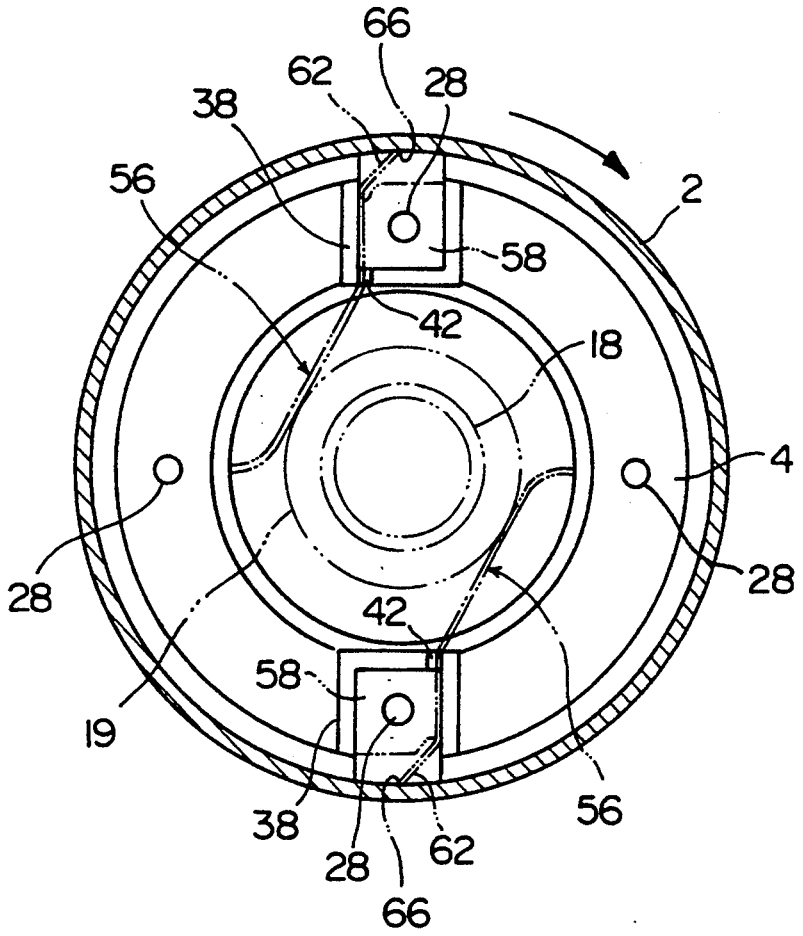
FIG. 2 is a sectional schematic view along the line 3—3 in FIG. 1.

A drive device in an image-forming machine improved according to the present invention will now be described in detail by way of an embodiment by referring to FIG. 1 through FIG. 5. In FIGS. 1 and 2, a transmission member 6 is detachably fitted to a flange member 4 that is so fitted to a photosensitive drum 2 as to rotate together therewith. The transmission member 6 is made of a synthetic resin or preferably a polyacetal and includes an output gear 10 that engages with a drive gear 8 of a transfer drum (not shown). The output gear 10 is formed on the outer periphery of a cylindrical portion 12 formed on one end side of the transmission member 6. An outer peripheral support surface 14 is formed along the circumference on one end side of the flange member 4. An inner peripheral surface 16 of the cylindrical portion 12 of the output gear 10 is fitted to, and supported by, the outer peripheral support surface 14.

The invention will be described in further detail with reference to FIGS. 1 and 2. Reference numeral 18 denotes a stationary support shaft which is secured to upright support plates (not shown) that are provided in a housing that is not shown of the image-forming machine at a distance from each other in the back-and-forth direction (left is front and right is rear in FIG. 1). Though only partly shown in FIG. 1, a pair of flange members, i.e., a flange member (not shown) of the front side and a flange member 4 of the rear side, are rotatably fitted at a distance in the axial direction onto the stationary support shaft 18 that is constituted by a slender cylindrical member. Reference numerals 20 and 22 denote bearings which rotatably support the flange member 4 on the stationary support shaft 18. The photosensitive drum 2 is fitted to the flange member of the front side (hereinafter referred to as the front-side flange member) and to the flange member 4 of the rear side (hereinafter referred to as the rear-side flange member 4). The photosensitive drum 2 which is only partly shown in FIG. 1 consists of a cylinder that extends in a horizontal direction and has a suitable photosensitive material provided on the peripheral surface thereof.

Figure 3:
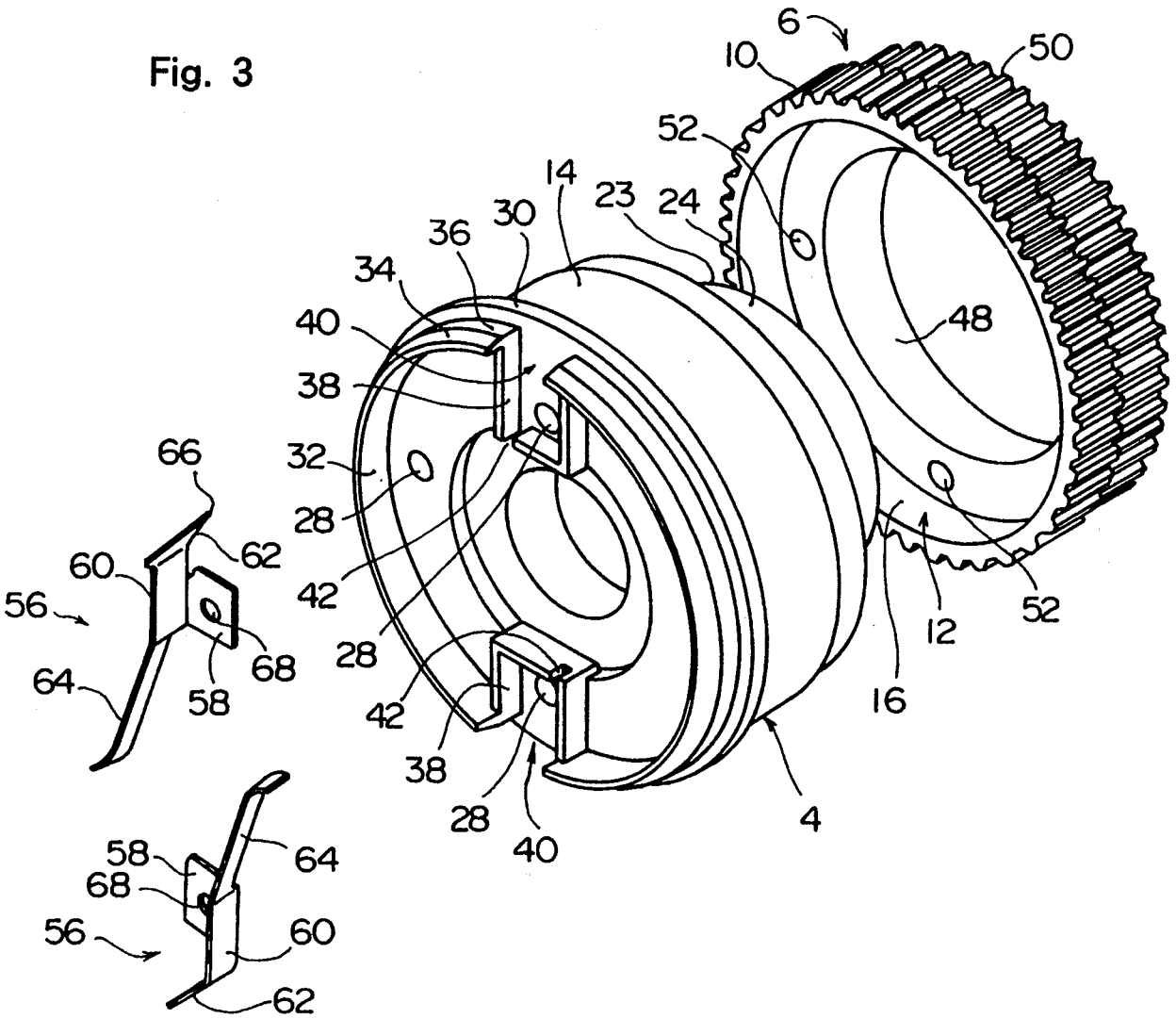
FIG. 3 is a perspective schematic view illustrating main portions of FIG. 1 in a disassembled manner.
Figure 4:
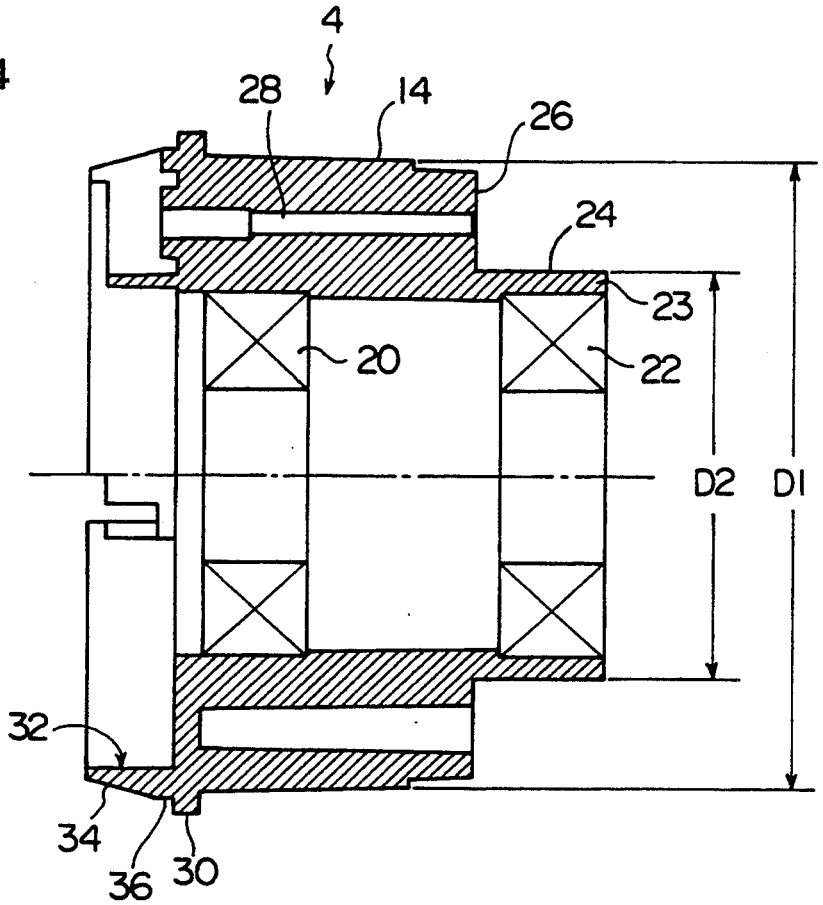
FIG. 4 is a sectional view of a flange member of FIG. 1.

Referring further to FIGS. 3 and 4, the outer peripheral support surface 14 is formed along the circumference on a rear end (one end) side of the flange member 4 which as a whole is nearly of a cylindrical shape. The outer peripheral support surface 14 has a slightly small diameter at the rear end thereof. The outer peripheral support surface 14 further has at its right end a cylindrical portion 23 of a small diameter that protrudes in the axial direction, and an outer peripheral support surface 24 of a small diameter is formed along the circumference of the cylindrical portion 23. An annular fitting surface 26 is formed between the outer peripheral support surface 14 and the outer peripheral support surface 24 of a small diameter. The fitting surface 26 is formed on a plane that intersects perpendicularly to the axis. A plurality of through holes 28 are formed in the flange member 4, the ends on one side thereof being open at the front end (other end) of the flange member 4 and the ends on the other side thereof being open at the fitting surface 26. A part of the through holes 28 that opens on the front end side of the flange member 4 are located in a fitting region 40 that will be described later. On the front end side of the outer peripheral support surface 14 of the flange member 4 is formed an annular flange portion 30 that outwardly extends in the radial direction, and a cylindrical portion 32 is formed in front of the annular flange portion 30 to protrude in the axial direction. The cylindrical portion 32 includes an introductory outer peripheral surface 34 having the shape of a circular truncated cone of which the diameter gradually decreases toward the front and a cylindrical outer peripheral support surface 36 which is continuous to the introductory outer peripheral surface 34. The outer peripheral support surface 38 has an outer diameter which is substantially the same as the inner diameter of the photosensitive drum 2. The cylindrical portion 32 is interrupted at two sites in the direction of diameter, the two sites being opposed to each other. In each of the interrupted portions, a rectangular fitting region 40 is defined by a protruding wall 38 of the shape of a channel. A notch 42 is formed on the inner side of the protruding wall 38 in the radial direction. The bearings 20 and 22 mentioned above are fitted to the inner peripheral portion of the flange member 4. The flange member 4 can be made of a synthetic resin but is preferably made of a metal such as a sintered metal.

Figure 5:
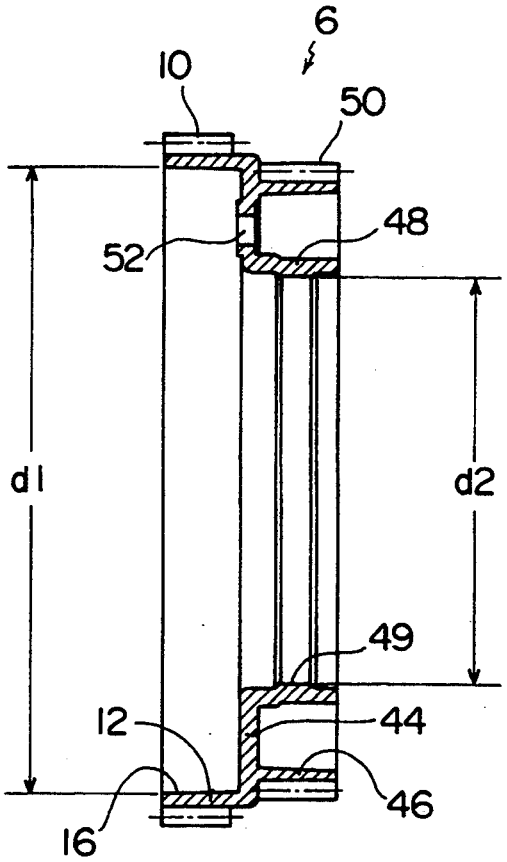
FIG. 5 is a sectional view of a transmission member of FIG. 1.

Referring to FIG. 5, the transmission member 6 includes an annular disk portion 44, two cylindrical portions 12 and 46 that are formed at the ends on the outer peripheral side of the annular disk portion 44 to protrude forward and backward in the axial direction, and a cylindrical portion 48 of a small diameter which is formed at an end on the inner peripheral side of the annular disk portion 44 to backwardly protrude in the axial direction. As described earlier, the output gear 10 is formed on the outer periphery of the cylindrical portion 12. An input gear 50 is formed on the outer periphery of the cylindrical portion 46. A plurality of fitting holes 52 are formed in the annular disk portion 44. As shown in FIG. 1, the transmission member 6 is attached to the flange member 4 by a bolt means (or specifically, by using screws 54) that are inserted in the fitting holes 52 and through holes 28 that are in match with each other under the condition where one side (front surface)

of the annular disk portion 44 is brought in contact with the fitting surface 26 of the flange member 4. Under the condition where the transmission member 6 is attached to the flange member 4, the inner peripheral surface 16 of cylindrical portion 12 of the output gear 10 is fitted to, and supported by, the outer peripheral support surface 14 as mentioned earlier. Moreover, the inner peripheral surface 49 of cylindrical portion 48 of a small diameter of the transmission member 6 is fitted to, and supported by, the outer peripheral support surface 24 of a small diameter of the flange member 4. In this embodiment, as will be apparent from FIG. 1, a part (a part in the axial direction) of the inner peripheral surface 16 of the cylindrical portion 12 is fitted to, and supported by, the outer peripheral support surface 14. Specific examples of sizes for accomplishing the fitting will be described with reference to FIGS. 4 and 5. The outer peripheral support surface 14 of the flange member 4 has an outer diameter D1 of 72.5 mm, and the inner peripheral surface 16 of cylindrical portion 12 of the output gear 10 that fits thereto has also an inner diameter d1 of 72.5 mm. Due to tolerance set for them, however, a relation $d1>D1$ is maintained. Furthermore, the outer peripheral support surface 24 of a small diameter of the flange member 4 has an outer diameter D2 of 47.0 mm, and the inner peripheral surface 49 of the cylindrical portion 48 of a small diameter of the transmission member 6 that fits thereto has also an inner diameter d2 of 47.0 mm. Due to tolerance set for them, however, a relation $d2>D2$ is maintained. The input gear 50 is drivably coupled to a rotary drive source (not shown) which may be an electric motor via a transmission gear train (not shown). The output gear 10 is brought into engagement with the drive gear 8 of the transfer drum that is not shown. When the rotary drive source is energized, the flange member 4 is rotated in the direction of arrow in FIG. 2. This rotation is transmitted to the transfer drum via the drive gear 8.

An earthing member 56 is fixed to each of the fitting regions 40 of the flange member 4. The earthing members 56 are made of a suitable resilient metal or preferably a spring steel such as SUS304CSP (JIS standard). As clearly shown in FIG. 3, each of the earthing members 56 formed by cutting and bending a metal plate has a rectangular fixing portion 58, a central portion 60 erected from one side of the fixing portion 58, a protruding coupling piece 62 that protrudes from one side of the central portion 60, and a protruding connection piece 64 that protrudes from the other side of the central portion 60. The protruding coupling piece 62 protrudes with an incline in a predetermined direction with respect to the central portion 60, i.e., in a direction indicated by arrow in FIG. 2. The protruding edge of the protruding coupling piece 62 extends rightwardly in FIG. 1 or outwardly in the radial direction, i.e., the tip 66 of the protruding coupling piece 62 is defined by a sharp vertex of an acute angle. On the other hand, the protruding connection piece 64 extends from the central portion 60 with an incline in the opposite direction and its tip is curved. A hole 68 is formed in the fixing portion 58 of the earthing member 56. The fixing portion 58 is fitted to the fitting region 40 of flange member 4, so that the through hole 28 of flange member 4 and the hole 68 are brought into match with each other. By inserting the screws in the holes 68 and through holes 28, the earthing members 56 are fixed to the flange member 4. In this embodiment, the aforementioned screws 54 are utilized to accomplish the fixing together with the transmission member 6. As will be understood from FIG. 2, the tip 66 of protruding coupling piece 62 of the earthing member 56 protrudes slightly outwardly in the radial direction beyond the interrupted site of cylindrical portion 32 of the flange member 4. The protruding connection piece 64 of the earthing member 56 extends inwardly in the radial direction through the notch 42 formed in the protruding wall 38 of flange member 4.

The front-side flange member that is not illustrated will now be briefly described. The front-side flange member has an annular plate as well as an inner cylindrical portion and an outer cylindrical portion that rearwardly protrude concentrically in the axial direction from the annular plate. Bearings are fitted in the inner cylindrical portion which is nearly of a cylindrical shape. The front-side flange member is rotatably fitted to the stationary support shaft 18 via the bearings. Like the flange member 4, the outer cylindrical portion which is nearly of a cylindrical shape has an introductory outer peripheral surface of the shape of a circular truncated cone of which the diameter gradually decreases rearwardly and an outer peripheral support surface of a cylindrical shape which is continuous thereto. Moreover, an annular flange portion that outwardly extends in the radial direction is formed at the front end in the axial direction of the outer peripheral support surface.

The front end of the photosensitive drum 2 is fitted to the outer cylindrical portion of the front-side flange member, or more specifically, is fitted to the outer peripheral support surface while being guided by the introductory outer peripheral surface, and the front edge of the photosensitive drum 2 is brought into contact with the rear side surface of the annular flange portion. As shown in FIG. 1, furthermore, the rear end of the photosensitive drum 2 is fitted to the cylindrical portion 32 of the rear-side flange member 4, or more specifically, is fitted to the outer peripheral support surface 36 while being guided by the introductory outer peripheral surface 34. The rear edge of the photosensitive drum 2 is brought into contact with the front side surface of the annular flange portion 30. Though not illustrated, the stationary support shaft 18 is externally threaded at a portion which is in front of the front-side flange member, and is screwed into a nut member. An annular holding groove is formed on the rear side in the axial direction of the nut member, and the front end of a compression coil spring is held in the holding groove. The rear end of the coil spring is brought in contact with the front surface of the bearing that is fitted to the front-side flange member. The coil spring constitutes a resilient urging means which resiliently urges the bearing rearwardly in the axial direction. An annular receiving portion inwardly protrudes in the radial direction at a rear protruding end in the axial direction of the inner cylindrical portion of the front-side flange member, the urging action of the coil spring is transmitted to the annular receiving portion from the bearing, and the front-side flange member is resiliently urged toward the back in the axial direction. Therefore, the resiliently urging action of the coil spring is transmitted to the photosensitive drum 2 via the front-side flange member, so that the photosensitive drum 2 is resiliently urged toward the back in the axial direction. The rear edge of the photosensitive drum 2 is pressed onto the front surface of annular flange 30 in the rear-side flange member 4, whereby the position of the photosensitive drum 2 is restricted in the axial direction.

When the photosensitive drum 2 is mounted on the front-side flange member and on the rear-side flange member 4 as described above, the tips 66 of protruding coupling pieces 62 of the earthing members 56 are pressed onto the inner peripheral surface of the photosensitive drum 2. The protruding coupling piece 62 of the earthing member 56 extends with an acute angle with respect to the inner peripheral surface of the photosensitive drum 2 on the upstream side as viewed in a direction indicated by arrow in FIG. 2, i.e., as viewed in a direction in which the rear-side flange member 4 rotates. In the illustrated embodiment, the tip 66 of the protruding coupling piece 62 is defined by a sharp vertex. Therefore, when the rear-side flange member 4 is rotated in the direction indicated by arrow in FIG. 2, the tip 66 of protruding coupling piece 62 of the earthing member 56 bites into the inner peripheral surface of the photosensitive drum 2. As a result, electrical conduction is maintained between the earthing member 56 and the inner peripheral surface of the photosensitive drum 2, and the electric charge flows from the photosensitive drum 2 into the earthing member 56 and is stored in an insulating member 19 which may be made of oxygen-free copper in the form of a pipe attached to the stationary support shaft 18 via a protruding connection piece 64 of the earthing member 56. The electric charge stored in the insulating member 19 is then grounded via an earthing line that is not shown. The rotation of the rear-side flange member 4 is transmitted, as a matter of course, to the photosensitive drum 2 that is fitted thereto to create the rotation in the direction indicated by arrow, together with the front-side flange member.

The transfer drum that is not shown includes a support shaft which is arranged substantially in parallel with the stationary support shaft 18 of the photosensitive drum 2. A pair of support members are arranged at a distance in the axial direction, and the support shaft is secured to the support members. The support members are mounted to rotate about a rotary axis which extends substantially in parallel with the support shaft, and are selectively located at an acting position and at a non-acting position by a suitable rotary mechanism that can be constituted by using an electromagnetic solenoid. The transfer drum is rotatably supported by the support shaft, and the drive gear of the transfer drum is provided at an end in the axial direction of the transfer drum. According to this embodiment, the drive gear is made of a metal or, preferably, a sintered metal and is engaged with the output gear 10 made of a synthetic resin of the photosensitive drum 2, so that the rotation of the photosensitive drum 2 is transmitted to the transfer drum via the output gear 10 and drive gear. When the transfer drum is located at the acting position, the output gear 10 of the photosensitive drum 2 and the drive gear of the transfer drum are engaged with each other as desired (they are in contact with each other on pitch circles), and the rotation of the photosensitive drum 2 is transmitted to the transfer drum in fully accurate synchronism as desired. When the transfer drum is located at the non-acting position, the output gear 10 and the drive gear of the transfer drum are not disengaged from each other, but are engaged with each other under a condition where a so-called back-lash is involved. Therefore, the rotation of the photosensitive drum 2 is kept transmitted to the transfer drum. Fundamental constitutions such as the structure for supporting the photosensitive drum relying upon the aforementioned flange members of the front side and the rear side, its drive mechanism, constitution of the transfer drum, its drive mechanism and the like have been disclosed in the U.S. Pat. No. 5,210,574.

When a multi-color image is to be formed on an image-forming sheet member (not shown) that is held on the transfer drum, the toner image is formed and transferred repetitively for each of the plurality of colors. The transfer drum stays at the non-acting position during from when the transfer of toner image of a given color is completed to when the transfer of toner image of a next color is started. When a desired image is formed on the image-forming sheet member, the image-forming sheet member is removed from the transfer drum and is conveyed through a toner image fixing means (not shown). That is, in the step of forming image, the transfer drum moves repetitively between the acting position and the non-acting position. The output gear 10 receives a load in the radial direction from the drive gear of the transfer drum every time when the transfer drum moves from the non-acting position to the acting position. However, the load is reliably received by the outer peripheral support surface 14 of the flange member 4.

Though the present invention was described above in detail by way of an embodiment, it should be noted that the invention is in no way limited to the above embodiment only but can be varied or modified in many other ways within the scope of the present invention.

The invention described above with reference to the embodiment offers the following effects.

(1) The inner peripheral portion of cylindrical portion of the output gear included in the transmission member made of a synthetic resin is fitted to, and supported by, the outer peripheral support surface of the flange member of the photosensitive drum. Therefore, the strength in the radial direction of the output gear can be kept in a manner where it is supported by the flange member which is different from the output gear. As a result, it is allowed to maintain a sufficiently great strength in the radial direction and a predetermined precision without increasing the thickness of gear portions of the output gear or without providing the gear body with a plurality of radial ribs. Accordingly, it is possible to obtain excellent image with high reliability.

(2) When the transmission member is so constituted as to include the input gear that is drivably coupled to the drive source, the output gear and the input gear can be formed as a unitary structure by using a synthetic resin, whereby they can be prepared in a mass-production and at a reduced cost.

(3) When the transmission member is made of a polyacetal, the gear is sufficiently guaranteed in wear resistance.

(4) When the flange members are made of a sintered metal, the load in the radial direction of the drive gear of the transfer drum can be received more reliably, i.e., the output gear exhibits sufficient strength in the radial direction.

(5) Widen the drive gear of the transfer drum is made of a metal, the relationship relative to the output gear is a combination of the metal and the synthetic resin, giving such merits that noise is decreased, no lubricant needs be applied, and production is carried out in a large quantity at a reduced cost.

What we claim is:

1. A drive device in an image-forming machine, comprising:

a flange member fittable to a rotating photosensitive drum so as to rotate therewith, an outer peripheral support surface being formed along a circumference on one end side of said flange member; and a transmission member detachably fitted to said flange member, said transmission member being made of a synthetic resin and including a cylindrical portion formed on one end side of said transmission member, an output gear that engages with a drive gear of a transfer drum, said output gear being formed on an outer periphery of said cylindrical portion formed on one end side of said transmission member, and an inner peripheral surface of said cylindrical portion being fitted to, and supported by, said-outer peripheral support surface, and an input gear that is drivably coupled to a rotary drive source, and wherein said transmission member further includes an annular disk portion, two cylindrical portions that are formed at the ends on the outer peripheral side of said annular disk portion to protrude toward both sides in the axial direction, and a cylindrical portion of a small diameter which is formed at an end on the inner peripheral side of said annular disk portion to protrude toward one side in the axial direction, one of said two cylindrical portions is said cylindrical portion in which said output gear is formed, said input gear is formed on the outer periphery of the other one of said two cylindrical portions, and a plurality of fitting holes are formed in said annular disk portion;

an outer peripheral support surface of a small diameter is formed circumferentially on said end side of said flange member to protrude in the axial direction, an annular fitting surface is formed between said outer peripheral support surface and said outer peripheral support surface of a small diameter, and a plurality of through holes are formed in said flange member in a manner that the ends on one side thereof are open at the other end of said flange member and the ends on the other side thereof are open at said fitting surface;

said transmission member is mounted on said flange member by a bolt means inserted in said fitting holes and through holes that match with each other under the condition where one side of said annular disk portion is brought in contact with said fitting surface of said flange member; and the inner peripheral surface of said cylindrical portion of a small diameter of said transmission member is fitted to, and is supported by, said outer peripheral support surface of a small diameter of said flange member under the condition where said transmission member is mounted on said flange member.

2. A drive device in an image-forming machine according to claim 1, wherein said synthetic resin of which said transfer member is made is a polyacetal.

3. A drive device in an image-forming machine according to claim 1, wherein said flange member is made of a sintered metal.

4. A drive device in an image-forming machine according to claim 1, wherein said drive gear of said transfer drum is made of a metal.

* * * * *